United States Patent [19]

Holzinger et al.

[11] Patent Number: 4,776,275

[45] Date of Patent: Oct. 11, 1988

[54] PYROTECHNICAL DELAY COMPOSITION

[75] Inventors: Walter Holzinger, Deisenhofen; Robert Gebhardt, Poing; Franz Hieble, Neu-Ulm, all of Fed. Rep. of Germany

[73] Assignee: Bayern-Chemie Gesellschaft Fur Flugchemische Antriebe mbH, Fed. Rep. of Germany

[21] Appl. No.: 92,057

[22] Filed: Sep. 1, 1987

[30] Foreign Application Priority Data

Sep. 4, 1986 [DE] Fed. Rep. of Germany ..... 3630081

[51] Int. Cl.[4] ..... C06C 5/06

[52] U.S. Cl. ..... 102/275.3; 102/275.12; 102/202.3

[58] Field of Search ..... 102/202.13, 275.2, 275.3, 102/275.11, 275.12

[56] References Cited

U.S. PATENT DOCUMENTS

| | | | |
|---|---|---|---|
| 3,336,869 | 8/1967 | Peterson et al. | 102/275.3 |
| 4,350,097 | 9/1982 | Bowman et al. | 102/275.3 X |
| 4,479,436 | 10/1984 | Wilson | 102/275.11 |

*Primary Examiner*—Peter A. Nelson

*Attorney, Agent, or Firm*—McGlew & Tuttle

[57] ABSTRACT

In order to achieve a delay time as constant as possible, an interspace is provided between a pyrotechnic delay composition and the delay tubule.

2 Claims, 1 Drawing Sheet

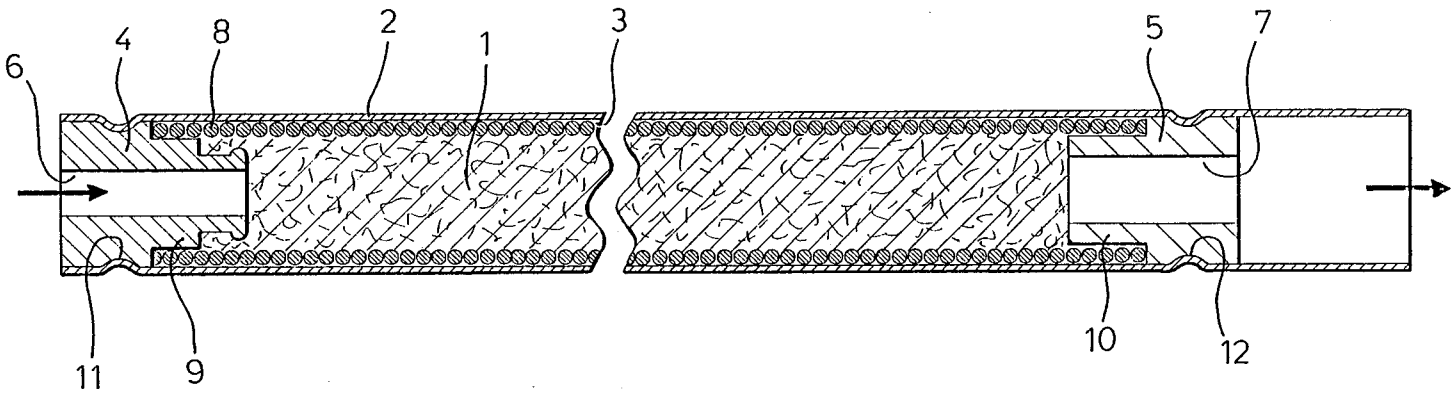
7
5
3
1
2
8
4
6
12
10
9
11

PYROTECHNICAL DELAY COMPOSITION

BACKGROUND OF THE INVENTION

Field of the Invention

The invention relates, in general, to ammunition and propellants and, in particular, to a new and useful pyrotechnic composition with a mixture of metallic reducing agents, inorganic oxidizing agents and possibly further additions in a delay tubule.

Similar delay compositions are known. The substance mixture is pressed into the delay tubule and the reducing agent(s) and oxidizing agent(s) are so laid out that the mixture burns with the least possible release of gaseous reaction products. The release of hot gases is nevertheless not entirely avoided. On the other hand, the burning down of the propellant composition is temperature and pressure dependent. The hot gases stored in the delay composition enclosed by a delay tubule therefore influence the reaction kinetics, and thus the delay time. This has, in particular when longer burning compositions are used, a negative effect.

As explained above, this behaviour cannot be eliminated by choice of mixture, since a totally gas-less reaction is not yet available. For decreasing the gas generation, decreasing the diameter of the delay composition cannot be applied indefinitely. For, through such a decrease, the heat transmission from the burning delay composition via the delay tubule to the surrounding is increased, which also affects delay time and, in the extreme case, can lead to an extinction of the delay composition.

SUMMARY OF THE INVENTION

The invention provides a pyrotechnic delay composition, which has a delay time which is reproducible as much as possible.

With the delay composition according to the invention, the hot gases released in the burning process can stream into the interspace between the delay composition and the delay tubule. In this way, the heat and the pressure of the hot gases, which otherwise effect the delay composition, can at least partially be channelled into the interspace and the effect of the hot gases on the delay composition can be correspondingly reduced.

With this measure the diameter of the delay composition no longer needs to be brought close to the critical diameter and the influence of the ambient temperature on the delay time is reduced. This influence is further reduced in that the released amount of gas in the interspace between the delay composition and the delay tubule forms a standing gas buffer, which additionally insulates the delay composition with respect to the surrounding.

The interspace is preferentially maintained by spacers between the delay composition and the delay tubule. It is of advantage, if, for example, metal rings are arranged as spacers between the delay composition and the delay tubule. A spiral spring has proven to be particularly useful. Through the windings of such a spring, the heat conduction takes place preferentially in the radial direction, e.g. the heat of the hot gases in the interspace is carried off in the direction toward the delay tubule. In this way, a prewarming of the delay composition preceding and increasing the velocity of burning is largely prevented through the hot gases in the interspace.

Accordingly, it is an object of the invention to provide a pyrotechnic delay composition which comprises a delay tubule, the delay composition therein including a mixture of at least one metallic reducing agent, at least one inorganic oxidation agent and selected further additions which are placed in the tubule in spaced relationship to the interior of the tubule wall, so that an interspace between the delay tubule and the delay composition is provided.

A further object of the invention is to provide a pyrotechnic delay composition which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWINGS

In the Drawings:

The only FIGURE of the drawings is an axial sectional view of a pyrotechnic delay composition constructed in accordance with the invention.

GENERAL DESCRIPTION OF THE PREFERRED EMBODIMENTS

Referring to the drawings, in particular, the invention embodied therein comprises a pyrotechnic delay composition which includes a delay tubule 2 having a delay composition 1 therein which is formed as a rod-like construction and wherein the delay composition 1 is spaced from the interior wall of the tubule 2 leaving an annular space or interspace 3.

The delay composition 1 includes a rod, for example pressed or extruded of a mixture of metallic reducing agents, inorganic oxidizing agents and further inert additions, like a plastic binding substance. It is arranged in a delay tubule 2, and at a distance from it, e.g. by forming an annular interspace 3.

The delay tubule 2 is closed at both ends by closing stoppers 4 and 5. The respective closing stoppers have bores 6 and 7 which, are provided to permit connecting to a (not shown) pyrotechnic input signal and output signal lines.

Around the delay composition 1 in the interspace 3, a spiral spring 8 of metal is arranged, which extends into respective annular recesses 9 and 10 in the closing stoppers 4 and 5. The delay tubule 2 is fastened by pressing it into grooves 11 and 12 at the circumference of the closing stoppers 4 and 5.

What is claimed is:

1. A pyrotechnic delay composition, comprising a metal delay tubule, a burnable delay composition which has a progressive burning zone when ignited including a mixture of at least one metallic reducing agent, at least one inorganic oxidation agent, and selective further additions disposed in said delay tubule in spaced relationship to the interior of said delay tubule so that between said delay tubule and said delay composition there is an interspace, said interspace providing a flow path for combustion gases forming a gas cushion therein during burning of said delay composition, a spiral spring in said interspace providing spaced-apart contact between said delay composition and said tubule and providing only an intermittent contact from the burning zone to said spring along its spiral configuration and heat conduction along the spiral spring which slows down preheating.

2. A pyrotechnic delay composition according to claim 1, wherein said tubule includes an outer casing, a stopper fitted into each end of said casing at each end of said delay composition, said stoppers each having a bore defining a respective pyrotechnic input signal and output signal line, each of said stoppers having an annular recess and a spiral spring of metal material disposed in said annular recess and aligned with said interspace

* * * * *